United States Patent [19]

Bull

[11] Patent Number: 4,570,840

[45] Date of Patent: Feb. 18, 1986

[54] NAILING GUN

[76] Inventor: William T. Bull, 3133 Telegraph Rd., Fillmore, Calif. 93015

[21] Appl. No.: 461,681

[22] Filed: Jan. 27, 1983

[51] Int. Cl.[3] ..... B25C 1/02

[52] U.S. Cl. ..... 227/8; 227/114; 227/120; 227/130

[58] Field of Search ..... 227/8, 114, 115, 116, 227/95, 109, 136, 120, 130

[56] References Cited

U.S. PATENT DOCUMENTS

| | | | |
|---|---|---|---|
| 2,879,509 | 3/1959 | Congden | 227/109 |
| 3,437,249 | 4/1969 | Baum | 227/120 |
| 3,491,932 | 1/1970 | Novak | 227/136 |
| 3,580,455 | 5/1971 | Cast | 227/8 |
| 3,820,705 | 6/1974 | Beals | 227/120 |
| 3,920,169 | 11/1975 | De Caro | 227/95 |
| 4,136,810 | 1/1979 | Bull | 227/120 |
| 4,139,136 | 2/1979 | Catalano | 227/109 |
| 4,313,552 | 2/1982 | Maurer . | |
| 4,326,661 | 4/1982 | Maurer | 227/109 X |

*Primary Examiner*—James M. Meister
*Assistant Examiner*—John L. Knoble
*Attorney, Agent, or Firm*—Christie, Parker & Hale

[57] ABSTRACT

A fore chamber assembly of a nailing gun serially feeds nails by gravity through a channel into a firing chamber. A nail head fence prevents the heads of trailing nails from underriding the heads of preceding nails and getting more than one nail in the firing chamber. The fence is vertically adjustable to work on different thickness nail heads. A safety link prevents firing of the gun unless the gun abuts the structure to be nailed and in that attitude applies a friction lock to nails in the fore chamber to prevent kickback of these nails upon gun firing. This lock is through a sliding cam and lever that engages a resilient button that in turn engages some of the nails. A feed magazine has spaced rails defining a slot that accepts loose nails in any orientation so long as their heads are on the rails with the nail shanks in the slot. The magazine rails are secured together by a cover that overlies the slot and nail heads and depending flanges that attach to the rails. A keeper interdicts the firing chamber to engage a nail in the chamber and hold it in place, and retracts under the force of the nail driver against the bias of a spring upon gun firing.

19 Claims, 5 Drawing Figures

NAILING GUN

BACKGROUND OF THE INVENTION

The present invention relates in general to the art of nailing, and, more in particular, to the art of automatic nailing tools.

Nails for years have been driven by hand-held hammers. In comparatively recent times nailing guns have become available. The guns are usually pneumatically powered, extracting energy from compressed air to drive nails at the command of a gun's operator. The guns have a body housing the passages, valving and pistons used in converting the pneumatic energy into the kinetic energy of the driver. A driver head of the gun has a firing chamber that receives individual nails and orients nails into the path of the driver. A magazine feeds nails to the chamber.

The nails for automatic nailing guns have come either prepackaged or loose. Prepackaged nails are oriented with their axes in a plane, their heads overlapping, their shafts parallel, and their shafts held together by parallel plastic bands. A spring-loaded follower urges the banded nails towards the chamber of the gun. With the driving of each nail, a new nail advances into the chamber for subsequent driving. Prepackaged nails are more expensive than loose nails because of the requirement for packaging. Some prepackaged nails have a portion of their heads sheared off to avoid double driving, the head shearing is an additional fabrication expense. The packaging comes apart upon the driving of the nails and can make the work place slippery and hazardous. Spring-fed followers tend to buckle the nails that they are urging against, limiting the number of nails in a package of nails.

Attempts have been made to overcome the disadvantages of prepackaged nail guns. One such gun is described in U.S. Pat. No. 4,136,810. That patent describes a loose nailing gun having a magazine that orients the nails in echelon fashion for feed into the firing chamber of a gun. Feed is by gravity. A dog in the firing chamber holds a nail there and retracts in response to a force applied to it through the nail head by the driver.

A loose nail gun is also described in U.S. Pat. No. 3,504,840 to O. A. Wandel et al. The Wandel device has a magazine that has a worm that advances nails serially into the firing chamber of the gun. It maintains nail orientation and displacement by the restraint of the lands of the worm at the cost of complication, expense and weight.

A third type of a loose nail gun is described in U.S. Pat. No. 3,491,932 to Novak. The Novak device utilizes a nail arrest of a toothed plate; each tooth has a ramp that permits nail advance and the retraction of the plate from the path of nails and a steep shoulder that prevents nail kickback in a direction opposed to nail advance. This nail arrest necessitates a wide magazine and is attendant with considerable mechanisms for its working. It is not responsive to free nails when the gun disengages from the workpiece in order to assure orderly advance of the nails.

A fourth device is described in U.S. Pat. No. 3,820,705 to Beals. Beals shows a gravity-fed magazine that feeds nails into the driving chamber of the nail gun and holds them there through a spring-loaded detent. The weight of the nails is aided by a weight trailing the nails. There is no provision for nail arrest or for preventing a trailing nail from underriding the head of a nail in front of it.

SUMMARY OF THE INVENTION

The present invention provides an improvement for nailing guns that effects reliable gravity feed of loose nails into a firing chamber of gun and in a nail feeding mechanism for the gun. It has a fence or limit member that prevents nail heads from underriding preceding heads and double firing of nails. It also employs a kickback arrest means that engages nails, preferably upon the gun engaging the workpiece to be nailed, and prevents nails from traveling in a direction opposite from the feed direction.

In one aspect, the present invention provides an improved nailing gun having a nose that includes a fore chamber assembly which serially passes nails through a channel into a firing chamber of the nose. A fence or limit of the fore chamber assembly lies above the channel and prevents trailing nail heads from underriding preceding nail heads and causing the double firing problem. This fence is vertically adjustable to accommodate different nail head thicknesses. In particular form, the fence includes a flat, continuous member pivotally mounted to the assembly near its entrance opposite the nose and an eccentric mounted nearer the nose so that the fence can be tilted with respect to the nail head path. The nail arrest couples directly to a safety link of the gun that prevents firing unless the gun nose rests against the workpiece being nailed. In particular form, the safety link carries a cam that engages a pivoted lever which in turn through a shoe presses against a resilient detent which in turn engages nails in the channel and provides the arrest. Preferably the detent is formed of a rubber-like material. A magazine for the gun includes two substantially parallel rails which define at their top a track for the under surfaces of nail heads and a slot between them so that nail shanks go between the rails in the slot with the under surfaces of the nail heads in engagement with tracks. A unifying cover overlies the tracks and is spaced from them to provide nail head clearance. The cover has alternate flanges that attach to alternate of the rails to secure the cover in place and the rails together. A clip at the tail of the magazine accepts a second auxiliary magazine of loose nails and directs the nails into the gun magazine. The tail end of the gun magazine has a latch that effects a secure engagement with the auxiliary magazine and permits feed from the auxiliary magazine into the gun magazine. The latch also serves the function of preventing nails from leaving the gun magazine through the tail of that magazine.

A keeper pin in the firing chamber is biased in that direction by a resilient spring and interdicts individual nail heads in the chamber. The axis of the pin is at an acute angle to the axis of travel of the driver so that the driver produces a retraction force on the pin to force it out of the way of the nail while the nail is being driven.

The safety link is spring-biased into a position that prevents gun firing and into a position where the nails of the position where the nail arrest is not engaged. The nails are substantially free to move within the fore chamber and magazine. This spring is overcome by the weight of the gun and the counteracting force of the workpiece on the safety link. As previously brought out, when the link is thus activated the nail arrest engages nails and prevents kickback during firing.

These and other features, aspects and advantages of the present invention will become more apparent from the following description, appended claims and drawings.

DESCRIPTION OF THE PREFERRED EMBODIMENT

Figure 1:
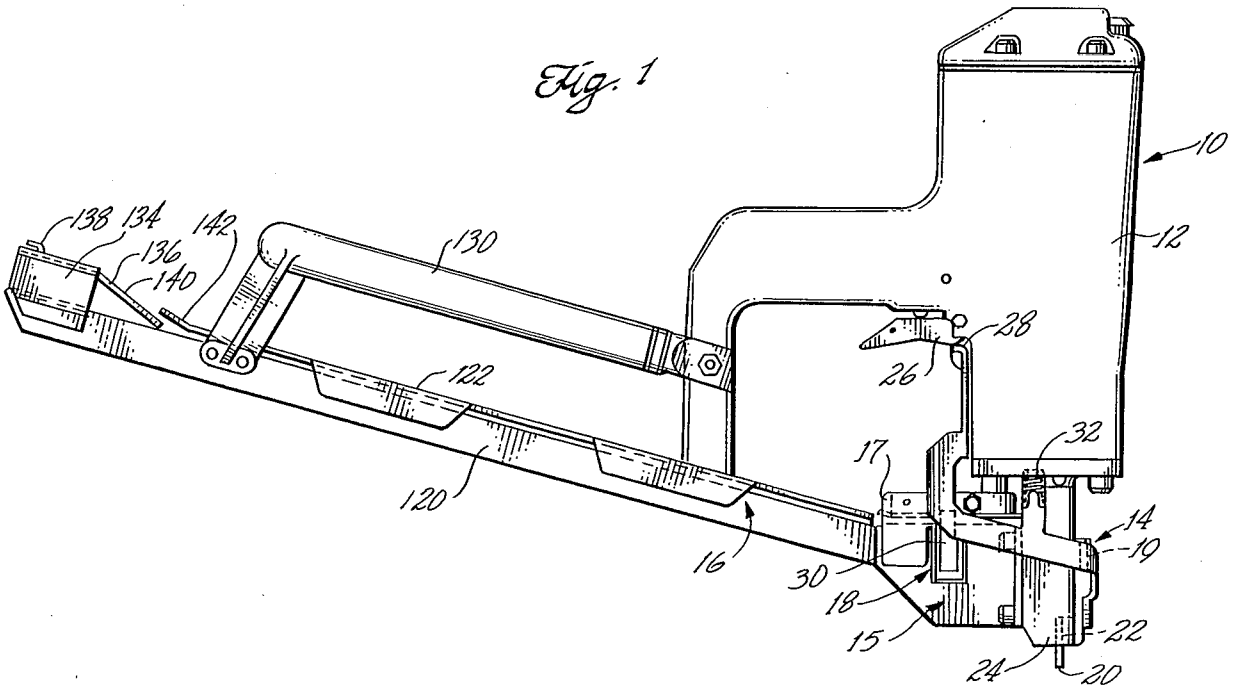
FIG. 1 is a side elevation view of the preferred form of the nailing gun of the present invention.

The general organization of the improved nailing gun is shown in FIG. 1. In that Figure the nailing gun 10 includes a gun proper 12, a nose assembly 14, a prechamber assembly 15 and a magazine assembly 16. The gun proper is known and its description is not necessary, other than to say that it is a pneumatically operated tool that has a reciprocating pin-like driver that on a downstroke drives a nail under the power of pneumatic pressure.

The magazine feeds by gravity serially oriented loose nails into the nose assembly. In the nose assembly, the nails in a feed channel are prevented from underriding nails that have preceded them by a nail fence 17, and nails are prevented from being kicked back in the direction of the magazine when the gun is applied to a workpiece in preparation for nailing by a nail arrest 18.

Nose assembly 14 includes a safety link 19 that has a finger 20 for physically engaging the workpiece. The finger guides in a guide way 22 in a nose piece 24 of the nose assembly. The link extends with its major plane normal to the plane of FIG. 1 upwardly, and then laterally towards the viewer, and then, with its major plane parallel to the plane of FIG. 1, upwardly and toward the magazine, past the nose assembly, over the prechamber assembly, and then, with its major plane normal to the plane of the Figure, up to a trigger 26 of the gun. The link has a safety lug 28 preventing the trigger from rotating and firing while the link is in the position shown in FIG. 1 with finger 20 distended. When finger 20 engages a workpiece and withdraws flush with the bottom of the assembly and link 18 translates upward, the trigger may be pulled to fire the gun. This aspect of the safety link is known.

The safety link mounts a cam 30 attached to it that forms a part of the nail arrest, to be described in detail subsequently, but which serves to prevent nails from reversing direction and traveling towards the magazine upon firing of the gun, an anti-kickback quality, and which engages nails when the link has been translated by the gun pressing against a workpiece. A spring 32 between the gun body and safety link biases the safety link towards the safety engaged position in which the nail arrest is disengaged and the gun cannot be fired.

Figure 2:
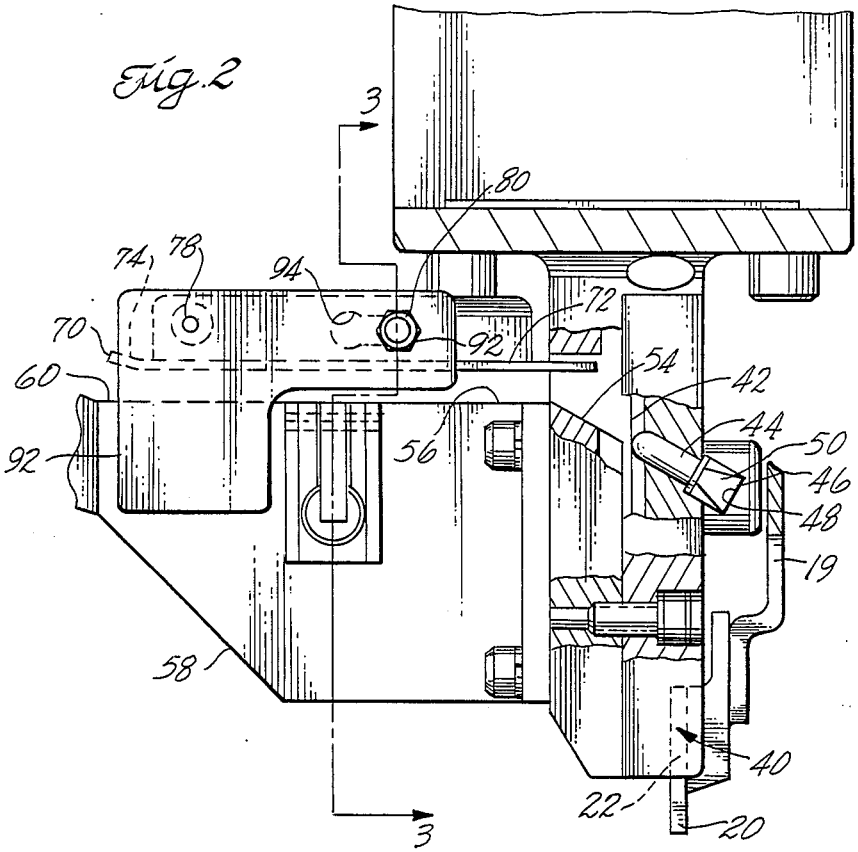
FIG. 2 is a side elevation view of the nose assembly of the gun of FIG. 1, partly broken away in half section.
Figure 4:
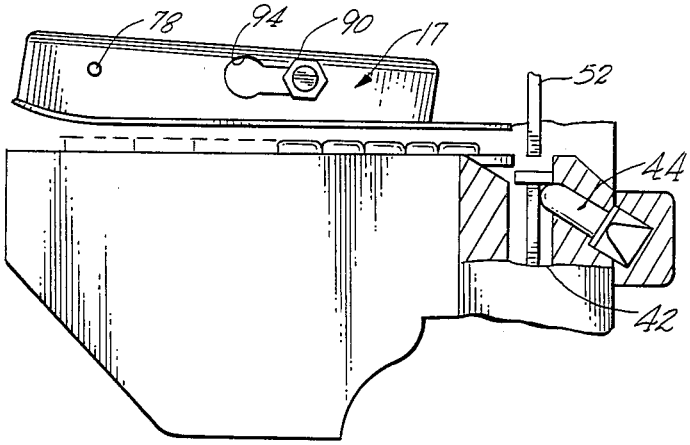
FIG. 4 is a fragmentary view in elevation of the nose assembly illustrating an array of nail heads and the prevention of underriding by trailing nail heads of preceding nail heads and a fence adjustment that accommodates different height dimension nail heads.
Figure 3:
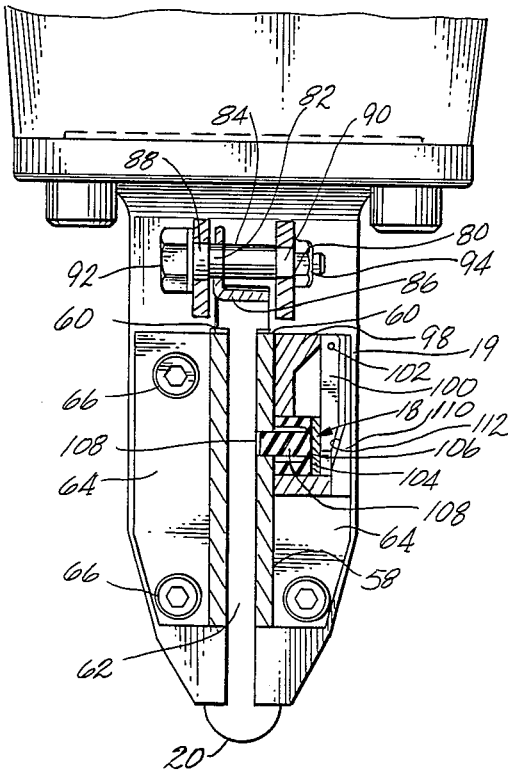
FIG. 3 is a view taken in the plane of 3—3 of FIG. 2.

FIGS. 2 and 3 illustrate the nose assembly in greater detail. Here, the safety link 19 is seen attached to finger 20 through a coupling slide 40. Guide way 22 in the nose tracks the finger and stabilizes the workpiece end of the link. The nose has a firing chamber 42 into which nails drop in preparation for firing. The chamber is on the axis of the driver of the gun which actually drives the nails. The firing chamber is interdicted by a detent pin 44 that is biased into the interdicting position by a spring 46 housed in a cavity 48 of a detent mount 50. As can be seen in FIG. 4, the pin arrests nails in chamber 42 by contacting the shank of the nails and the under surface of the nail heads and keeps the nails in position for driving by a driver 52 of the gun. The detent pin has a cylindrical shank, a spherical nose and a distal flange. The latter acts as a limit to prevent excessive intrusion of the pin into chamber 42. Spring 46 is of a rubber-like material and biases the keeper against the limit of a shoulder of the nose assembly.

The nose assembly has a track that maintains orientation of the nails in serial fashion ahead of the firing chamber and assures nail presence there. In greater particular, the track is defined by a ramp 54 that drops the nails into the firing chamber from the prechamber assembly.

The prechamber assembly includes a horizontal track 56 ahead of ramp 54 in which heads are oriented so that they cannot stack with heads of following nails underlying heads of preceding nails. Track 56 maintains a serial order for the nails. In greater particular, prechamber assembly includes parallel side plates 58 that are spaced apart to define a channel 62 for nail shanks but which are sufficiently close together to define complementary tracks 60 for engaging the under surfaces of nail heads, keeping the nails on their track. This arrangement can be seen in FIG. 3 most readily. The side plates attach to the nose assembly through mounting flanges 64 and threaded male fasteners 66.

A nail head limiting fence assembly 17 prevents the underriding of the preceding nail heads. This fence includes a continuous elongated fence member that extends from the entrance to the fore chamber to an end over ramped section 54. The fence member has a pilot portion 74 that flares open in the direction of the magazine to guide nail heads onto tracks 60. The fence is pivotally connected to the side plates through a mounting bracket 76 and a pivot pin 78 at the end of the fence opposite the firing chamber so that the end of the fence closest to the firing chamber may be vertically adjusted to adjust the distance between the fence and rails 60. This adjustment is effected through an eccentric 80 acting between the mounting bracket and fence. In greater particular, and with reference to FIG. 3, eccentric 80 comprises an eccentric journal 82 acting on a circular follower surface 84 of the fence member in an upstanding flange 86 of that member. The eccentric is journaled at journals 88 and 90 in the mounting bracket. An hexagonal head 92 provides for purchase of a wrenching tool to operate the eccentric. A lock nut 94 at the opposite end from the adjustment head secures the mechanisms together. The mounting bracket includes two parallel plates 92 welded to side plates 58. An access keyhole 94 in one of these plates permits mounting of eccentric 80.

Thus, the fence, by merely adjusting the angular position of head 92, alters the vertical position of continuous fence member 72 above tracks 60 to accommodate different sized nail heads and prevent undesirable stacking that produces double driven nails.

Nail arrest 18 mounts to one of the side plates 58 through a mount 98. It includes a lever 100 pivotally connected to the mount at 102. The lever engages a shoe 104 and a rubber button 106. The button has a finger 108 located in a hole in the side plate and which can go into the nail shank channel between the side plates to effect nail arrest. A slide 110 mounted to safety link 19 has a camming surface 112 that cooperates with a facing and complementary camming surface of the lever to effect depression of the button and the locking of the nails against kickback when the safety link is raised by finger 20 engaging a workpiece.

Figure 5:
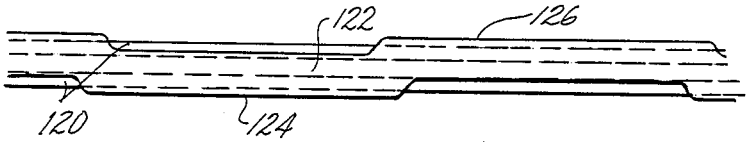
FIG. 5 illustrates in top plan, somewhat fragmented, the construction of the gun feed magazine.

As seen in FIGS. 1 and 5, magazine 16 consists of a pair of spaced-apart and parallel rails 120 secured together through roof 122 by alternate mounting flanges 124 and 126 that are welded to alternate of the rails. The cover prevents nails from leaving the magazine out its top. The mounting flanges of the cover effect a unity of rails and the roof. The top of the rails define tracks for the undersurface or nail heads. A handle 130 between the but of the magazine and the gun proper secures the magazine firmly to the gun. At the but end of the magazine, a clip 134 permits attachment of an auxiliary magazine to feed additional nails to the gun. The clip bridges the space between the rails and has a latch 136 mounted in it. The latch includes a tab 138 that extends above the surface of the clip and down through a hole into it. A diagonally extending tongue 140 rests on the track surface of the rails. This downwardly depending tongue prevents nails from backing out the rails when it is in the position shown. When the auxiliary magazine is in place, this downwardly depending tongue rests on the under surface of upwardly flared roof portion 142 of roof 122 and permits the passage of nails unencumbered between the auxiliary magazine and the illustrated magazine.

This invention effects the feeding of loose nails in an organized fashion through a magazine, into a prechamber assembly, and ultimately, one at a time, into the firing chamber of the nailing gun. This is done without underlapping of preceding nail heads by following heads. This is done while arresting nails during the drive cycle from kicking back in a direction opposite that of feed. All of the prechamber and its attendant nail arrest and nail head fence are of simple construction. The nail fence is adjustable to accommodate different height nails heads in the function of preventing underriding. The nail arrest occurs in connection with the freeing of the gun's trigger upon engagement of the nose of the gun with the workpiece to be nailed. The arrest is done through a very simple cam arrangement and a resilient button.

The present invention has been described with reference to a preferred embodiment. The spirit and scope of the appended claims should not, however, necessarily be limited to the foregoing description.

What is claimed is:

1. For use with a nailing gun having a reciprocating driver to drive nails into a workpiece, an improvement comprising:

(a) a magazine having a pair of spaced-apart rails for serially feeding loose nails by gravity;

(b) a prechamber assembly including means defining a channel for serially feeding loose nails by gravity from the magazine, a nail head fence above the channel to engage nail heads and prevent trailing nails from riding under preceding nail heads in the channel, the nail head fence including a flat, continuous member above the channel and means to adjust the spacing of the member from the channel;

(c) means on the prechamber for arresting nails and preventing them from moving in a direction opposite nail feed upon nail driving by the driver; and (d) a nose having a firing chamber aligned with the driver and in communication with the channel of the prechamber assembly for serially receiving nails from the prechamber assembly.

2. The improvement claimed in claim 1 including:

means for the arresting means to activate the latter only when the gun engages a workpiece to be nailed.

3. The improvement claimed in claim 2 wherein:

the means for the arresting means includes a safety link operable to prevent firing of the gun until the gun engages a workpiece to be nailed.

4. The improvement claimed in claim 3 wherein:

the arresting means includes a resilient rubber-like button mounted on the prechamber assembly to face the channel, and cam means coupled to the safety link to engage the button and extend it into the channel when the link moves in response to the gun engaging the workpiece.

5. The improvement claimed in claim 3 wherein the safety link is mounted to move in translation upon engaging the workpiece, and the arresting means includes a button mounted on the prechamber assembly facing the channel, a lever pivotally mounted on the prechamber assembly having an end in engagement with the button and a cam surface, and a slide having a cam surface complementing the cam surface of the lever for pivoting the lever and extending the button into the channel upon translation of the safety link in response to engagement of the workpiece by the gun.

6. The improvement claimed in claim 1 wherein the nail head fence member is pivotally mounted to the prechamber assembly proximate the entrance to it from the magazine, and the adjusting means includes an eccentric engaging the fence and mounted for rotation to the prechamber assembly such that rotation of the eccentric pivots the fence and changes the distance between the fence member and the channel.

7. The improvement claimed in claim 6 including means for the arresting means to activate the latter only when the gun engages a workpiece to be nailed, such means including a safety link operable to prevent firing of the gun until the gun engages a workpiece to be nailed.

8. The improvement claimed in claim 7 wherein the safety link is mounted to move in translation upon engaging the workpiece, and the arresting means includes a button mounted on the prechamber assembly facing the channel, a lever pivotally mounted on the prechamber assembly having an end in engagement with the button and a cam surface, and a slide having a cam surface complementing the cam surface of the lever for pivoting the lever and extending the button into the channel upon translation of the safety link in response to engagement of the workpiece by the gun.

9. In combination with a nail driving gun having a reciprocating driver, an improvement in a nail feeding mechanism comprising:

(a) a nose assembly having a firing chamber aligned with the driver for receiving a nail and setting the nail in a workpiece upon impact of the nail by the driver;

(b) means in the nose assembly interdicting the path of a nail in the firing chamber to keep the nail there prior to its being impacted by the driver;

(c) a prechamber assembly having means defining a channel for serially feeding nails into the firing chamber, a nail head fence overlying the channel, the nail head fence including means to adjust the spacing above the channel to provide a space for nail heads and preventing trailing nail heads from underriding preceding nail heads by the fence engaging the nail heads during the serial feed of nails into the firing chamber, and a nail arrest selectively actuatable upon engagement of a workpiece to arrest nails in the channel from movement away from the firing chamber; and (d) a gun magazine for serially feeding nails to the channel of the prechamber assembly.

10. The improvement claimed in claim 9 wherein the arresting means includes a lever pivotally connected to the prechamber assembly, a resilient button engaged by the lever and mounted in the prechamber assembly facing the channel to engage the shanks of the nails, and a cam disposed to engage the lever and rotate it to engage the button with the shanks of the nails to effect nail arrest, and means for selectively actuating the cam upon engagement of the workpiece by the gun.

11. The improvement claimed in claim 10 wherein the selectively actuatable means includes a safety link between a trigger of the gun and the nose assembly, the safety link having a finger engageable with the workpiece for translating the link and freeing the trigger for firing, the safety link carrying the cam for actuating the arrest.

12. The improvement claimed in claim 11 including biasing means for biasing the safety link into a position with the arrest means unengaged and the trigger disabled.

13. The improvement claimed in claim 9 wherein the gun magazine includes a pair of parallel rails defining at their tops a track for the nail heads, a cover spaced above the track and flanges depending from alternate sides of the cover with alternate of the flanges being attached to alternate of the rails and securing them and the cover together.

14. The improvement claimed in claim 13 including clip means for attachment of an auxiliary magazine to the gun magazine, the clip means straddling and overlying the rails and having a lever with a tongue extending into engagement with the rails to prevent nail reversal out of the gun magazine, the lever being rotatable into a position to permit the passage of nails on the attachment of the auxiliary magazine.

15. The improvement claimed in claim 9 wherein the fence includes spaced-apart and parallel members overlying the channel, and an elongated, continuous member between the parallel members and spaced above the channel, and the spacing adjusting means includes a pivot connecting the elongated member with the parallel members at an entrance end of the track from the gun magazine, and an eccentric mounted to the parallel members between them and engaged with the elongated member to effect rotation of it about the pivot and a variation of the distance between it and the channel to accommodate different nail head thicknesses.

16. The improvement claimed in claim 15 wherein the prechamber assembly includes a pair of parallel plates spaced apart to define the channel and having at their upper ends surfaces defining a track that supports nails by engaging the under surfaces of the nail heads, the plates being attached to the nose assembly with the channel oriented in line with the firing chamber, the nose assembly including a channel with a ramped track between the track of the prechamber assembly and the firing chamber, the ramped track acting as a transition between the two.

17. The improvement claimed in claim 9 wherein the interdicting means includes a pin biased into the firing chamber at an angle to the axis of the driver such that the underside of a nail contacting the end of the pin forces withdrawal of the pin from the chamber to free the nail for driving into a workpiece upon impact of the nail by the driver.

18. The improvement claimed in claim 15 wherein:

the arrest means includes a button mounted to a first one of the plates and extending through the plate for engagement with the shanks of nails in the channel of the prechamber assembly, a shoe at the opposite end of the button from the channel, a lever pivotally mounted to the first plate and engaging the shoe remote from the pivot mount, a cam surface on the lever lying at an angle to the axis of the driver, a slide having a cam surface complementing the cam surface of the lever and engageable with it such that upon movement the lever rotates to press the button through the shoe into the channel, and a translatable safety link between a trigger of the gun and the nose assembly, that in a first position prevents actuating the trigger unless the nose assembly engages a workpiece to be nailed and a second position permits such actuation, the slide being attached to the safety link to engage the lever and actuate the arrest when the safety link is in its first position.

19. An improved nailing gun comprising:

(a) the gun having means for reciprocally powering a driver to engage a nail and drive it into the workpiece and a trigger to actuate the powering means;

(b) a nose assembly having a firing chamber in line with the driver for receiving a nail for driving by the driver and a track for passing nails into the firing chamber with the heads of the nails on the track;

(c) a safety link mounted to the gun between the trigger of the gun and the end of the nose assembly for movement between a first position disabling the trigger from actuating the powering means when the nose assembly is out of contact with a workpiece and a second position permitting such actuation when the nose assembly is in contact with the workpiece;

(d) means in the nose assembly for keeping a nail in the firing chamber prior to the nail's being impacted by the driver, such means yielding to the force of the driver on the nail to displace out of the path of the nail head as the nail is being driven;

(e) a prechamber assembly attached to the nose assembly including a pair of parallel and spaced-apart plates defining a channel through which nails can serially pass onto the track of the nose assembly;

(f) a head fence including a pair of parallel members attached to the side plates and defining a space between them, an elongated member overlying the channel and spaced from it pivotally connected to the parallel members at an entrance into the channel remote from the nose assembly, an eccentric mounted to the parallel members and acting on the elongated member remote from the pivot and proximate the nose assembly to vary the distance of the elongated member from the channel and accommodate different sized nail heads and prevent trailing nails from underriding preceding nails, an arrest mechanism including a button mounted in the wall of one of the side plates and extending into the channel for acting on the shanks of nails and preventing the nails from reversing direction upon impact of the driver on a nail in the firing chamber, a shoe on the button, a lever having one end acting on the shoe and the other end pivoted to the side plate, a camming surface on the lever, a slide having a complementary camming surface in line with the camming surface of the lever and attached to the safety link for extending the button into the path of the nails when the safety link engages a workpiece; and (g) a feed magazine having a pair of spaced-apart rails defining a slot for serial passage of nails into the channel of the prechamber and including a roof overlying the channel and spaced from it, the roof having alternate laterally and depending mounting flanges extending from it into attachment with the rails to hold the rails and roof together.

* * * * *